United States Patent [19]

Lash et al.

[11] Patent Number: 4,579,031

[45] Date of Patent: Apr. 1, 1986

[54] TWO CYCLE AIR CUT-OFF PRESS

[75] Inventors: Edward G. Lash, Huntington Woods; Roger Levy, Oak Park; Everett Gleason, South Lyon, all of Mich.

[73] Assignee: Tishken Products Co., Detroit, Mich.

[21] Appl. No.: 647,042

[22] Filed: Sep. 4, 1984

[51] Int. Cl.[4] ..... B26D 5/12; B26D 5/18

[52] U.S. Cl. ..... 83/626; 83/630; 83/639

[58] Field of Search ..... 83/630, 639, 616, 640, 83/624, 626; 100/272, 281

[56] References Cited

U.S. PATENT DOCUMENTS

| | | | |
|---|---|---|---|
| 2,156,323 | 5/1939 | Tishken | 83/290 |
| 3,183,743 | 5/1965 | O'Donnell | 83/630 X |
| 3,545,368 | 12/1970 | Lickliter et al. | 100/49 |
| 4,172,401 | 10/1979 | Albareda | 83/630 |

FOREIGN PATENT DOCUMENTS

| | | | |
|---|---|---|---|
| 670334 | 1/1939 | Fed. Rep. of Germany | 100/272 |

*Primary Examiner*—James M. Meister
*Assistant Examiner*—John L. Knoble
*Attorney, Agent, or Firm*—Cullen, Sloman, Cantor, Grauer, Scott & Rutherford

[57] ABSTRACT

In a two cycle air cut-off press having a bed plate, guide posts, a top plate upon the posts and a ram plate guidably mounted upon the post defining with the bed plate a die set area an improved power mechanism for the ram plate including first and second cylinder assemblies mounted upon the top plate including piston rods. A bell-crank is pivotally mounted upon the top plate and pivotally connected to the piston rods. A toggle linkage including a plurality of pairs of pivotally interconnected upper and lower links at their outer ends are connected respectively to the top plate and to the ram plate. A horizontally reciprocal control arm is connected to the toggle linkage and to the bell-crank whereby on alternate reciprocal movements of the piston rods and reciprocal pivotal movements of the bell-crank, the control arm is reciprocated and through the linkage effects reciprocal vertical movements of the ram plate. In the modified cut-off press the bell-crank is omitted and the cylinder assemblies and piston rods are mounted upon side plates, with the piston rods connected to opposite ends of the control arm, for reciprocating the control arm and the toggle linkage vertically reciprocating draw rods connected to the arm plate.

11 Claims, 4 Drawing Figures

43
151
45
49
41
145
149
141
131
147
137
155
159
47
157
153
59
57
53
61
77
79
81
85
87
91
83
89
139
143
145
135
133
55
56

TWO CYCLE AIR CUT-OFF PRESS

BACKGROUND OF THE INVENTION

The present invention relates to a two cycle air cut-off press having a stationary bed plate and a ram plate defining a die set area, with an upper movable die set connected to the ram plate and a lower stationary die set connected to the bed plate. With such a construction the lower die set is adapted to receive and intermittently cut-off or otherwise impinge upon a transversely movable workpiece or stock which is engageable with the upper die set.

THE PRIOR ART

Illustrative of the prior art is U.S. Pat. No. 3,545,368 dated Dec. 8, 1970 of Robert Paul Lickliter et al showing a pneumatic press with a cylinder reciprocated ram plate.

U.S. Pat. No. 2,156,323 dated May 2, 1939 of Paul Tishken is illustrative of a modified cut-off press wherein the power means effects reciprocal movements of the plurality of draw rods for effecting corresponding reciprocal movements of a ram plate or head.

SUMMARY OF THE INVENTION

An important feature of the present invention is to provide a cut-off press or apparatus having an improved power mechanism for reciprocally feeding the ram plate with respect to a bed plate. A die set area is provided between the plates and includes opposed upper and lower track members for mounting upper and lower die sets respectively. With such a construction an elongated transversely adjustable workpiece is movable over the lower die set and the upper die set is adapted to intermittently act upon and cut-off portions of the workpiece that passes transversely over the lower die set.

Another feature of the cut-off press or apparatus is the provision of a toggle linkage for effecting reciprocal movements of a ram plate which is guidably mounted upon the apparatus to achieve a mechanical advantage provided by such toggle linkage and increased forces provided by the ram plate upon a workpiece.

A further feature of the cut-off press or apparatus is the provision of a pair of separately operated pneumatic cylinder assemblies which are connected to the toggle linkage either directly or indirectly causing such transverse adjustments of the toggle linkage as to effect reciprocal movements of the connected ram plate.

A still further feature of the cut-off press or apparatus as described is to provide a bell-crank assembly which, intermediate its ends, is pivotally mounted upon the top plate of the press and is pivotally connected adjacent its opposite sides to the respective piston rods of the cylinder assemblies. A horizontally reciprocal control arm is connected to the bell-crank and to the toggle linkage, so that alternate reciprocal movements of the piston rods effect intermittent rocking movement of the bell-crank and corresponding reciprocal translations of the control arm for effecting intermittent flexing of the toggle linkage such that increased downward forces are directed to the ram plate of the press upon intermittent reciprocal adjustments of the toggle linkage.

Another feature of the cut-off press or apparatus is the provision of a toggle linkage which includes a plurality of pairs of pivotally interconnected upper and lower links which at their outer ends are pivotally connected respectively to a stationary top plate and to the ram plate of the prress, together with reciprocal means for adjusting and flexing the toggle linkage. With such a construction the toggle linkage is alternately adjusted between outermost positions and at a central position with the links in alignment and with maximum downward forces exerted by the toggle linkage upon the ram plate of the press.

Still another feature is the provision of a modified cut-off press or apparatus having a pair of cylinder assemblies which are arranged in alignment and are adjustably mounted upon side plates of the press. With such a construction the piston rods are directly connected to a control arm for the toggle linkage for flexing the toggle linkage between its extreme positions and for effecting reciprocal movements of a ram plate.

A further feature is the provision of a modified cut-off press or apparatus in which the ram plate is mounted upon a plurality of upright spaced reciprocal draw rods and the support plate for the draw rods is connected to the toggle linkage for recriprocal movement.

These and other features and objects will be seen from the following Specification and claims in conjunction with the appended drawings;

THE DRAWINGS

It will be understood that the above drawings illustrate merely preferred embodiments of the invention and that other embodiments are contemplated within the scope of the claims hereafter set forth.

DETAILED DESCRIPTION OF AN EMBODIMENT OF THE INVENTION

Figure 1:
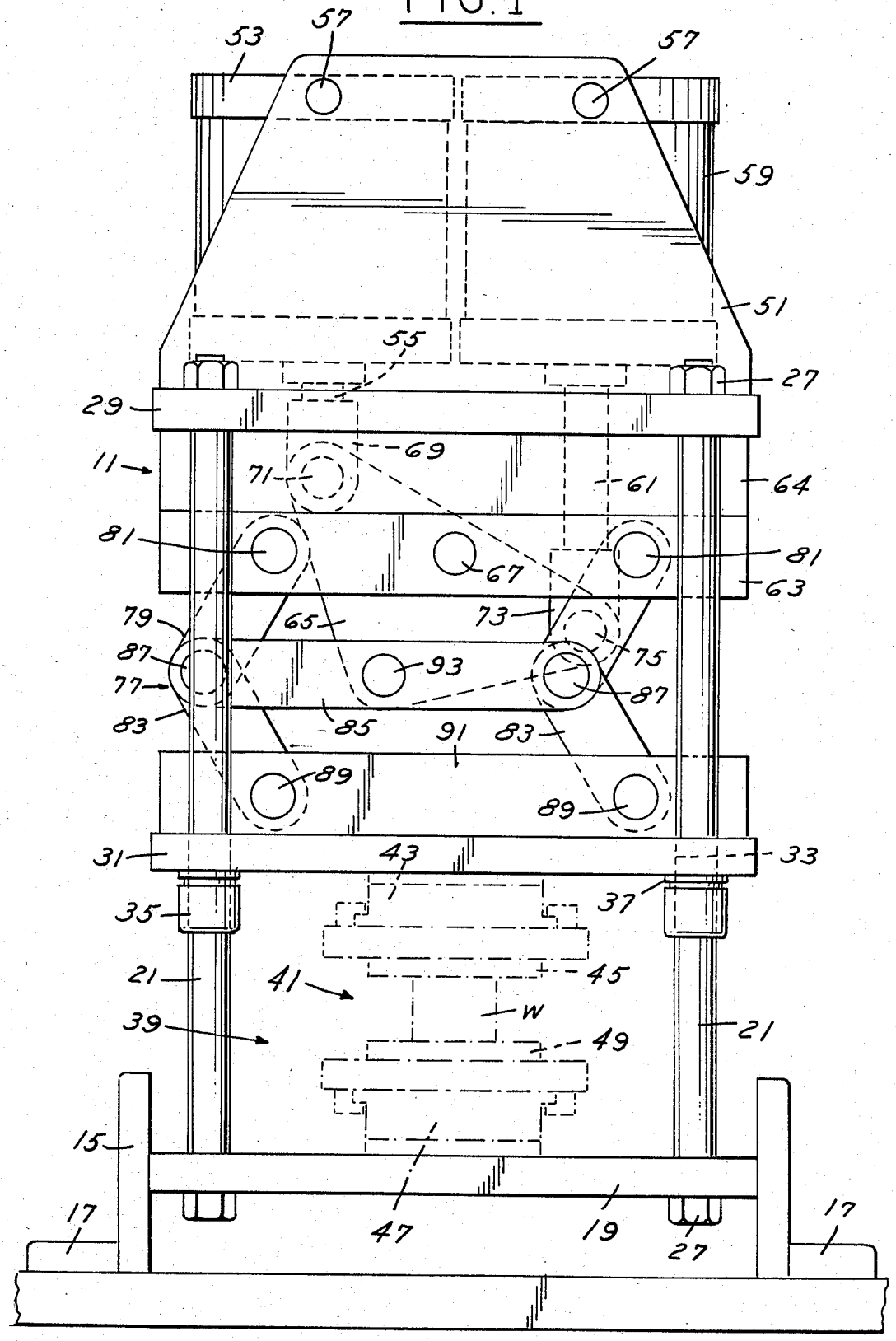
FIG. 1 is a front elevational view of the present two cycle air cut-off press employing a bell-crank operated toggle linkage.
Figure 2:
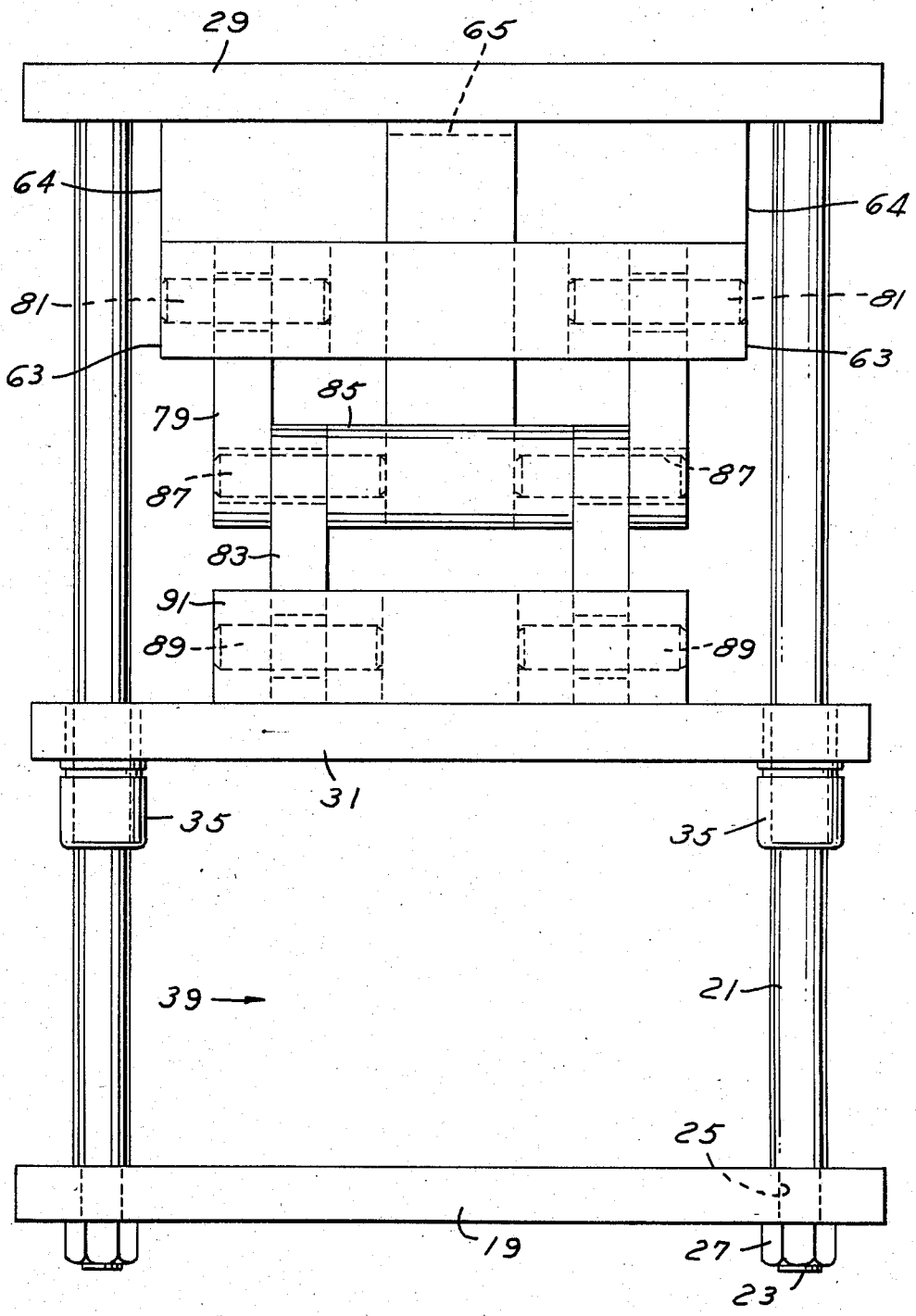
FIG. 2 is a fragmentary side elevational view of the cut-off press of FIG. 1.
Figure 4:
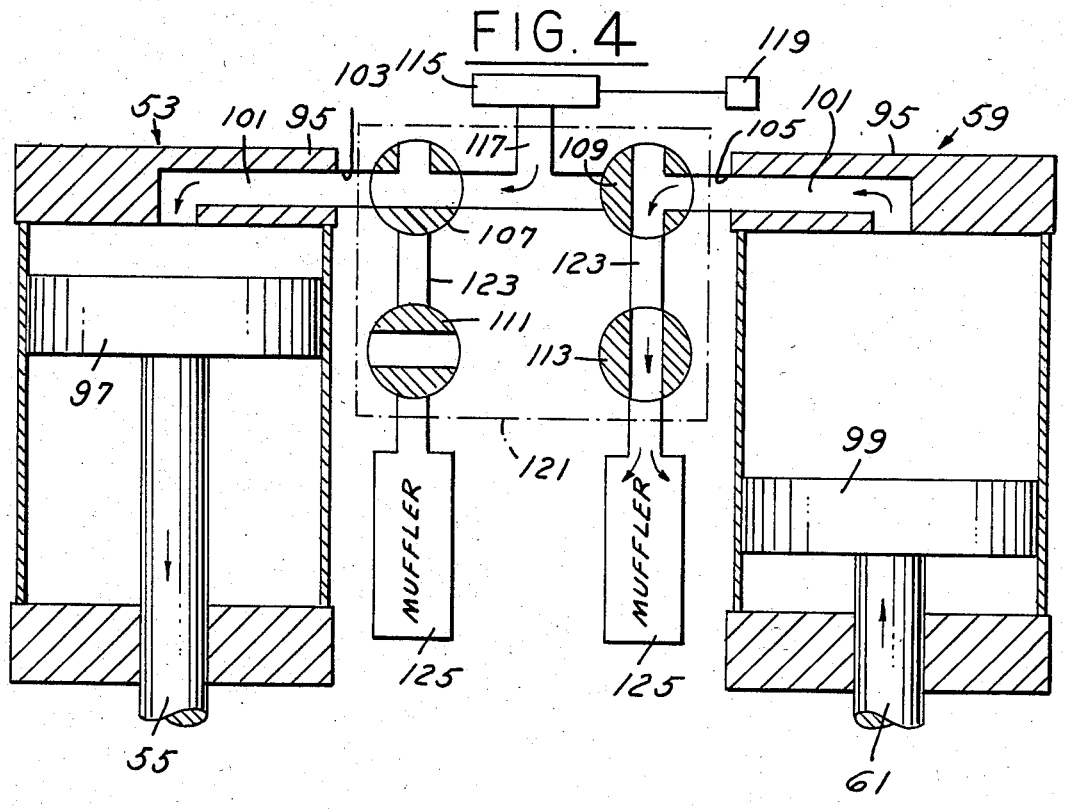
FIG. 4 is a fragmentary, schematic and sectioned view of the pneumatic circuit and control valve assembly for the intermittent operation of corresponding cylinders which are applicable to the presses shown in FIGS. 1 and 3.

Referring to the drawings, FIGS. 1, 2 and 4, the present two cycle air cut-off press is generally indicated at 11, FIG. 1, and includes a base 13, fragmentarily shown, and secured thereon a pair of upright bed plate supports 15 with hold down anchor plates 17. Stationary bed plate 19, rectangular in plan, FIG. 2, supports adjacent its corners a plurality of laterally spaced upright guide posts 21, whose threaded lower ends 23 extend through bores 25 provided in bed plate 19 and are secured thereto by fasteners or nuts 27. An apertured stationary top plate 29 overlies and receives the upper threaded ends of guide posts 21 and is secured thereto by fasteners 27.

Ram plate 31 has corresponding bores 33 adjacent its corners and slidably receives the upright guide posts 21, respectively. A plurality of guide bushings 35 depend from ram plate 31 in registry with bores 33 to cooperatively and guidably receive the respective guide posts. The guide bushings 35 are suitably secured to the undersurface of ram plate 31, such as by the welds 37 or other suitable anchor.

Ram plate 31 defines with stationary bed plate 19 a die set area 39 within which is positioned the die set assembly 41. Upper trackway 43 is suitably secured to and depends from ram plate 31 and has adjustably mounted thereon and suitably secured thereto upper reciprocal die set 45, including blade 46 or other tooling.

Lower trackway 47 overlies and is suitably secured to bed plate 19 and has mounted and secured thereon stationary lower die set 49. Suitable guide rods, not shown, but conventional in the art are interposed between the respective upper and lower die sets 45 and 49 to maintain the die sets in proper alignment at all times and during reciprocal movements of ram plate 31.

Longitudinally extending workpiece W extends into and through the die set area 39 and is supported upon the lower die set 49. The upper die set 45 is adapted for intermittent operative cut-off or other working engagement with the workpiece W.

Depending from the upper die set 45 is the cut-off blade 46, for illustration or other tooling adapted for intermittent operative or cut-off engagement with workpiece W upon lower die set 49, and during continuous reciprocal movements of ram plate 31. It is regarded as equivalent that any other form of tooling may be employed, instead of the cut-off blade 46 shown in FIG. 1.

A pair of upright first and second cylinder assemblies is suspended from the top plate 29. The cylinder assemblies include a first cylinder 53 having a reciprocal piston 97, FIG. 4, and an axially connected depending piston rod 55, shown in a retracted position in FIGS. 1 and 4.

A pair of laterally spaced upright end plates 51 are mounted upon and secured to the top plate 29. Pivot rod or pin 57 extends between and is mounted upon the plates 51 and also extends through an upper end portion of cylinder assembly 53. The second cylinder assembly 59 includes a second cylinder having a piston 99, FIG. 4, and an axially depending piston rod 61, shown in an extended position in FIGS. 1 and 4.

Stationary support plates 63 are interposed between the respective guide posts 21 and are suspended from the top plate 29 by the support blocks 64, FIGS. 1 and 2. An upright bell-crank 65, of a triangular shape, FIG. 1, is interposed between the support plates 63 and is pivotally mounted upon the support plates 63 by the central bell-crank pivot or pivot rod 67.

Yoke 69 upon the lower end of piston rod 55 is pivotally connected by pivot pin 71 to one side of bell-crank 65. A yoke 73 is secured upon the outer end of the piston rod 61 and is pivotally connected by pivot pin 75 to the opposite side of the bell-crank 65, which has a depending apex 76, FIG. 1.

A toggle linkage 77 is interposed between the top plate 29 and he ram plate 31. The toggle linkage 77 includes a plurality of spaced pairs of pivotally interconnected upper and lower links 79 and 83. These links 79 and 83 at their outer ends are pivotally connected respectively to the top plate 29 including support plate 63 by the pivot pins 81 and to the ram plate 31 and its connected actuator plate 91 by the pivot pins 89, FIGS. 1 and 2.

The inner overlapped ends of the respective pairs of links 79, 83 are pivotally interconnected by the transverse pivot pins 87, sometimes hereafter referred to as the center pivot means. These center pivot means interconnect the inner overlapped ends of each pair of upper and lower links 79, 83.

A horizontally reciprocal control arm 85 is positioned between the respective pairs of upper and lower links 79, 83, with the links arranged upon opposite sides of the control arm 85 and adjacent its opposite ends, FIGS. 1 and 2. The control arm 85 adjacent its opposite ends is pivotally connected to the corresponding overlapped inner ends of the pairs of upper and lower links 79, 83 by the same pivot pin 87, sometimes referred to as the center pivot means.

The control arm 75 intermediate its ends is pivotally connected to the apex portion 76 of bell-crank 65 by the pivot pin 93, FIG. 1. The connection of the lower links 83 to the respective portions of the ram plate 31 includes spaced actuator plates 91 connected to the ram plate 31 to receive the pivot pins 89. Thus, the lower links 83 of the respective pairs of links are pivotally connected to ram plate 31.

In operation, alternate intermittent reciprocation of the respective piston rods 55 and 61 effects reciprocal pivotal movements of bell-crank 65 in a vertical plane, with the bell-crank 65 pivotally supported on plates 63, at 67, FIG. 1. Such pivotal movements of the bell-crank 65 effect horizontal reciprocal movements of control arm 85. The corresponding center pivot means 87 move from outermost or innermost extreme positions with respect to a vertical centerline between the corresponding pivot pins 81 and 89.

In the position of the toggle linkage 77 shown in FIG. 1, wherein the respective pairs of upper and lower links 79, 83 are in extreme positions, the ram plate 31 is shown in the retracted position. As the respective links 79, 83 move towards and into alignment, the ram plate 31 has been forcefully moved downwardly to its lowermost position, with the upper die set 45 in operative engagement with workpiece W upon the lower die set 49.

For illustration, the last quarter inch of downward stroke of the ram plate 31 provides a working force in the ratio of 8 to 1, approximately. The present toggle linkage 77 provides a multiplier factor for transmitting reciprocal movements of the respective piston rods from rocking movements of the bell-crank 65 and reciprocal movements of control arm 85 and through the toggle linkage 77 into reciprocal feed movements of ram plate 31.

In operation, with reciprocal pivotal movements of bell-crank 65 about its pivot mount 67, the outer end portions of the bell-crank 65 at the pivotal connections 71 and 75 move laterally outward a limited amount. This is permitted by the swivel support mount 57 for the corresponding cylinders 53 and 59, FIG. 1. The respective piston rods 55 and 61 and yokes 69, 73 extend through corresponding apertures within the top plate 29.

There is schematically shown in FIG. 4 a pneumatic diagram for controlling the intermittent alternate operation of cylinder assemblies 53 and 59. Each of the cylinders have common intake and exhaust passages 101 which connect with conduits 103 and 105 in valve housing 121. Within valve housing 121, there are provided a pair of normally non-energized control valves 107 and 109. In FIG. 4, the first valve 107 has been energized to an open position and the second valve 109 is in a non-energized condition. Normally closed two-way valve 111 is positioned within the valve housing 121 blocking off the flow of exhaust air through one of the exhaust conduits 123 through the connected muffler 125.

The normally closed two way valve 113 is positioned within valve housing 121 and normally blocks off the flow of exhaust through a second exhaust conduit 123 and connected muffler 125. As schematically shown in FIG. 4, air reservoir or accumulator tank 115 has a compressed air outlet 117 which communicates with the conduits 103 and 105 under the control for the normally closed three way valves 107 and 109.

Reservoir 115 is connected to a suitable source of compressed air at 119. The positioning of the respective valves 107 and 109 alternately controls the flow of pressurized air through one or the other of the passages 101, as for example to cylinder 53, FIG. 4 for pressurizing piston 97 to extend the piston rod 55.

For this purpose, valve 107 has been automatically moved to the open position shown so that pressurized air from the reservoir 115 can flow through valve 107, through passage 103 and conduit 101 into the upper end of cylinder 53. At the same time, the second control valve 109 is non-energized and remains in such position so that as the piston 99 in the second cylinder 59 retracts under the action of the bell-crank 65, the exhaust air therein moves outwardly as shown by the arrows. Exhaust air passes through exhaust passage 101 and conduit 105, through the valve 109 through exhaust passage 123, through the open valve 113 and through muffler 125 to atmosphere.

For an explanation of the operation of the respective valves 107, 109, 111 and 113 at the beginning of the stroke of piston 97, there is the following working condition:

1. Valve 107 is energized and open.
2. Valve 109 is not energized and closed.
3. Valve 111 is not energized and closed.
4. Valve 113 is energized and open.

At about the middle of the downward stroke of piston 97, FIG. 4, the following condition exists:

1. Valve 107 is not energized and closed.
2. Valve 109 is not energized and closed.
3. Valve 111 is not energized and closed.
4. Valve 113 is energized and open.

Exhaust air from the upper end of cylinder 59 under the force of the retracting piston 99 flows through the combination exhaust and intake passages 101, 105, through the open valve 109, through the open exhaust valve 113 and through muffler 125 to atmosphere.

For effecting a stop of the piston 97 in anticipation of the application of pressurized air to the piston 99 of the second cylinder assembly 59 and with the stroke of piston 97 being 75% complete, the valves are not energized, with the result that flow of pressurized air to cylinder 53 is blocked as is the exhaust from the cylinder assembly 59.

With valve 111 also not energized both of the exhaust conduits 123 are blocked with the result that there is a mechanical stopping of the movement of both pistons 97 and 99.

For the beginning of the stroke working portion for the second cylinder assembly 59, the following valve conditions exist:

1. Valve 107 is not energized and closed.
2. Valve 109 is energized and open.
3. Valve 111 is energized and open.
4. Valve 113 is not energized and closed.

By this construction, the pressurized air at 117 passes through valve 109, through the passages 105 and 101 into the upper end of cylinder 59 causing piston 99 and the connected piston rod 61 to advance downwardly. At the same time, the bell-crank 65 causes upward movement of piston rod 55 and piston 97 so that exhaust air above piston 97 moves through passages 101 and 103, through the valve 107, through the open exhaust valve 111 and through muffler 125 to atmosphere. As an intermediate condition, the valve conditions are as follows:

1. Valve 107 is not energized and closed.
2. Valve 109 is not energized and closed.
3. Valve 111 is energized and open.
4. Valve 113 is not energized and closed.

This cuts off the flow of pressurized air to the upper end of cylinder 59 and piston 99. However, the exhaust from cylinder 53 is free to pass through the non-energized valve 107 and through the open exhaust valve 111 to atmosphere.

With the stroke of piston 99 75% complete no valves are energized. Air is trapped in both cylinders 53, 59 to cause an immediate stop of the respective pistons therein and connected bell-crank 65.

This succession of operation of the corresponding valves may be controlled automatically by (a) suitable valve controls connected to the respective valves for operation in the desired time sequence and (b) suitable switching mechanism for automatically operating the valves in the above sequence.

In operation, the advancing of one piston rod rotates the bell-crank 65 in one direction, with the bell-crank retracting the other piston rod. The air in the corresponding cylinder escapes through the exhaust passage 101 and through one of the exhaust conduits 123, FIG. 4.

More broadly defined in connection with the cylinders 53 and 59, there is provided an adjustable three way valve means embodied in the pair of valves 107 and 109 which are connected to a source of pressurized air at 115–117–119. Pressurized air passes through conduits 101 alternately communicating pressurized air to one cylinder, with the other cylinder exhausting to atmosphere. When the corresponding valve means 107–109 is moved to a second position, pressurized air is connected to the second cylinder 59 with the first cylinder 53 exhausting to atmosphere.

Whatever cylinder is pressurized, the other cylinder is delivering the exhaust through the corresponding passage 101, through one or the other of the exhaust passages 103, through the open exhaust control valve 111 or 113 and through the corresponding muffler 125. The primary purpose of the mufflers 125 on the exhaust conduits is to reduce the noise level of the exhaust air passing therethrough, in compliance with Federal regulations.

Figure 3:
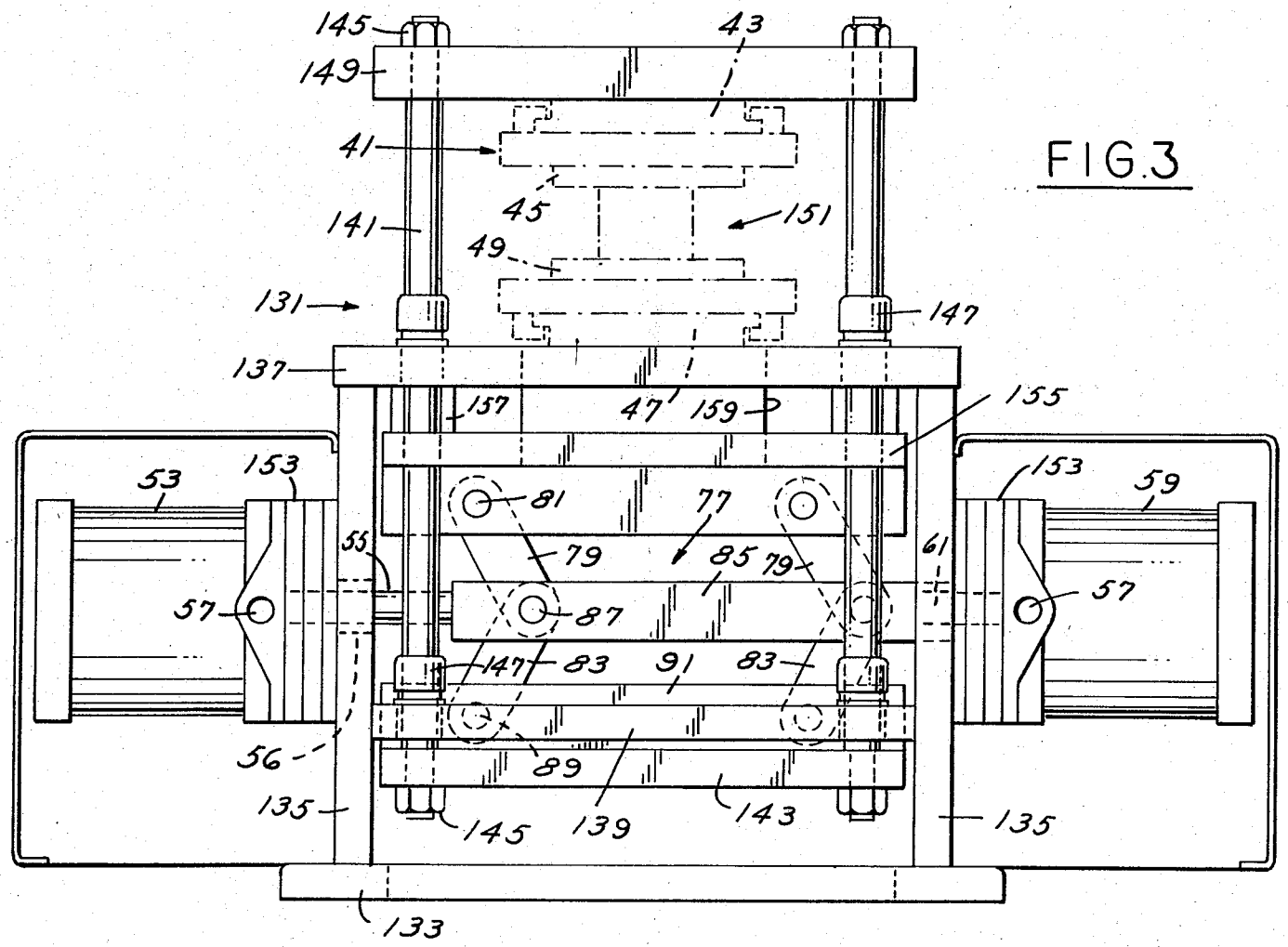
FIG. 3 is a front elevational view of a modified two cycle air cut-off press with the toggle linkage directly operated by the pneumatic cylinders.

It is contemplated that bell-crank 65 be replaced by a pair of pneumatic cylinders, such as shown at 53 and 59, FIG. 3. Here the cylinders are directly connected to conrol arm 85 such that intermittent operation of cylinders 53 and 59 will effect intermittent reciprocal movements of control arm 85 for effecting intermittent reciprocal movements of toggle linkage 77 and ram plate 31.

MODIFICATION

A modified two cycle air cut-off press is generally indicated at 131, FIG. 3 and includes a bed plate 133 mounted upon a suitable support, not shown. A pair of upright spaced side plates 135 are mounted upon bed plate 133 and suitably secured thereto. The top bed plate 137 overlies and is secured to the side plates 135 and is also suitably apertured to receive draw rods 141.

Spacer rod guide plate 139 is interposed between the lower end portions of side plates 135, is suitably secured thereto and includes a plurality of apertures therein through which extend the corresponding draw rods 141. The corresponding draw rods 141 extends through the top bed plate 137 and thereabove. The draw rods 141 extend downwardly through corresponding apertures within the spacer rod guide plate 139. The rod support plate 143 is apertured to receive the threaded ends of draw rods 141 which are secured thereto by fasteners or nuts 145.

Corresponding bushings 147 are mounted upon the top bed plate 137 and upon the mount guide plate 139 and are suitably secured thereto as by welding or otherwise. The respective bushings 147 are adapted to cooperatively and guidably receive the reciprocal draw rods 141.

Ram plate 149 is apertured to receive the upper threaded ends of draw rods 141 which are secured thereto by corresponding fasteners or nuts 145. Ram plate or head 149 defines with the underlying top bed plate 137 a die set area 151 corresponding to die set area 39 of FIG. 1. The same die set 41 as described with respect to FIG. 1 is interposed within the die set area 151. The corresponding upper and lower die set assemblies 45 and 49 are adjustably secured to the corresponding trackways 43 and 47. The respective trackways are secured to the adjacent ram plate 149 and top bed plate 147, in a conventional manner, with suitable guide rods or other guide means interposed between the respective die set assemblies as is conventional in the art.

For the modification shown in FIG. 3, the mounting of the respective first and second cylinder assemblies 53 and 59 includes opposed pairs of cylinder supports 153 which are mounted upon and project outwardly of the side plates 135 and are suitably secured thereto. The respective cylinders at their inner ends are projected between the side plates 153 and pivotally connected thereto by the transverse pivot pins 57, in a manner similar to that described with respect to FIG. 1. The corresponding piston rods 55 and 61 are thereby arranged in alignment on a horizontal axis and extend through corresponding apertures 56 within the side plates 135.

The inner ends of the aligned piston rods 55 and 61 are connected axially to opposite ends of the control arm 85. Alternate reciprocal activations of the respective cylinders or cylinder assemblies 53 and 59 are adapted to effect alternate reciprocal movements of piston rods 55 and 61 and the control arm 85 in a substantially horizontal plane.

In view of the nature of the toggle linkage 77, with the upper ends of the upper links 79 connected to a fixed support at 81, after the links 79 have been moved by the control arm 85 into substantial alignment, the control arm 85 is moved downwardly a limited distance. This is provided for in view of the pivotal mounting at 57 of the corresponding cylinder assemblies 53 and 59.

While in FIG. 1, the reciprocal movements of the control arms 85 is controlled by alternate rocking movements of bell-crank 65, in the present embodiment, FIG. 3, such reciprocation is directly effected by the respective cylinders 53 and 59. The toggle linkage 77 effects reciprocal movements of the rod support plate 143 to reciprocate the draw rods 141 in unison and correspondingly the attached ram plate 149.

As shown in FIG. 3, the stationary plate 155 underlie and is secured to the top bed plate 137 by the support blocks 159 and intermediate spacers 157. Thus, it can be regarded in accordance with the present description that the stationary plate 155 depends from and is secured to the top bed plate 137. Thus, in effect, the upper links 79 of the toggle linkage 77 are pivotally connected as at 81 to the top bed plate 137.

The pneumatic connections above described with respect to FIG. 4 are equally applicable to the modified embodiment shown in FIG. 3, except that the cylinders or cylinder assemblies 53 and 59 are arranged in opposed alignment instead of side by side in FIG. 4. The pneumatic connections. however, are the same and the description of the operation of the valves is not repeated.

Having described our invention, reference should now be had to the following claims.

We claim:

1. In a two cycle air cut-off press having a stationary bed plate, spaced upright guide posts mounted upon the bed plate at their one ends and secured thereto, a stationary top plate secured over the other ends of said guide posts, an apertured ram plate guidably receiving and reciprocally mounted upon said guide posts and defining with said bed plate a die set area, and a pneumatic reciprocal power means connected to said ram plate;

the improvement of said power means comprising;

a pair of upright first and second cylinder assemblies suspended upon said top plate including depending first and second piston rods;

an upright bell-crank intermediate its ends pivotally mounted upon and depending from said top plate and at its opposite ends pivotally connected to said first and second piston rods respectively;

a toggle linkage between said top plate and ram plate including a plurality of spaced pairs of pivotally interconnected upper and lower links at their outer ends pivotally connected respectively to said top plate and to said ram plate;

center pivot means interconnecting the inner overlapped ends of each pair of upper and lower links;

a horizontally reciprocal control arm adjacent its opposite ends pivotally connected to said center pivot means, and intermediate its ends pivotaly connected to said bell-crank;

whereby alternate reciprocal movements of said piston rods effect reciprocal pivotal movements of said bell-crank and transverse reciprocal movements of said control arm, said toggle linkage effecting reciprocal movements of said ram plate;

said cylinder assemblies including first and second cylinders and pistons therein, each cylinder having a common intake and exhaust port;

a valve housing having an inlet for receiving pressurized air from a source;

a pair of pressure conduits in said valve housing connected to said cylinder ports;

first and second normally closed three way alternately actuated control valves in said valve housing for delivering pressurized air from one valve to one of said pressure conduits to one cylinder for advancing the piston therein;

a pair of exhaust conduits in said valve housing connected to each of said valves, the other cylinder pressure conduit being connected by the other valve to one of said exhaust conduits;

the advancing of said one piston rod rotating said bell-crank in one direction, said bell-crank retracting the other piston rod, the air in the corresponding cylinder escaping through its exhaust port and through one of said exhaust conduits; and a two way exhaust control valve within each exhaust conduit movable between open and closed positions, and when open permitting flow of exhaust air through the corresponding exhaust conduit.

2. In the cut-off press of claim 1, said center pivot means being reciprocally movable between outermost positions upon opposite sides of a center line between the pivotal connections of said links with said top plate and ram plate;

the maximum downward force being exerted by said linkage upon said ram plate when said upper and lower links approach alignment respectively.

3. In the cut-off press of claim 2, the last one quarter inch of downward stroke of said ram plate providing a working force in the ratio of 8 to 1, approximately.

4. In the cut-off prress of claim 1, the mounting of said cylinder assemblies including a pair of spaced upright end plates mounted upon said top plate;

and a pair of laterally spaced pivot rods interposed between said end plates and connected to and supporting upper end portions of said cylinder assemblies;

said piston rods extending loosely through said top plate;

said cylinder assemblies adapted for limited arcuate movements in a vertical plane on intermittent rocking movement of said bell-crank.

5. In the cut-off press of claim 1, said bell-crank being of triangular shape with a depending apex, said control arm being connected to said bell-crank adjacent its apex.

6. In the cut-off press of claim 1, said pairs of upper and lower links being arranged upon opposite sides of and adjacent opposite ends of said control arm.

7. In the cut-off press of claim 2, the ram plate being retracted when the center pivot means of each pair of link is in one of said outermost positions, and downwardly advanced when said upper and lower links are in alignment.

8. In the cut-off press of claim 1, opposed spaced upper and lower track members between and secured to said ram plate and bed plate respectively;

and opposed cooperating upper and lower die sets secured to said track members, respectively;

said lower die set adapted to supportably receive a workpiece intermittently fed transversely across the lower die set, said upper die set operably engaging said workpiece.

9. In the cut-off press of claim 1, spaced bushings secured to and depending from said ram plate cooperatively receiving said guide posts respectively.

10. In the cut-off press of claim 1, said exhaust valves when closed stopping movement of said ram plate.

11. In the cut-off press of claim 1, and a muffler on each exhaust conduit to reduce the noise level of exhaust air passing therethrough.

* * * * *